US007194943B2

(12) United States Patent
O'Dwyer

(10) Patent No.: US 7,194,943 B2
(45) Date of Patent: Mar. 27, 2007

(54) IGNITION ARRANGEMENT FOR STACKED PROJECTILES

(75) Inventor: Sean Patrick O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/519,614

(22) PCT Filed: Jul. 4, 2003

(86) PCT No.: PCT/AU03/00866

§ 371 (c)(1),
(2), (4) Date: Dec. 23, 2004

(87) PCT Pub. No.: WO2004/005836

PCT Pub. Date: Jan. 15, 2004

(65) Prior Publication Data

US 2005/0246934 A1 Nov. 10, 2005

(30) Foreign Application Priority Data

Jul. 5, 2002 (AU) ..... 2002950004

(51) Int. Cl.
*F41A 19/58* (2006.01)

(52) U.S. Cl. ..... 89/28.05; 89/1.41; 102/217

(58) Field of Classification Search ..... 102/345, 102/438, 505, 217; 89/1.41, 28.05
See application file for complete search history.

(56) References Cited

U.S. PATENT DOCUMENTS 69,707 A 10/1867 Rupertus
213,958 A 4/1879 Tyler
694,896 A 3/1902 Scott
4,123,975 A 11/1978 Mohaupt
4,791,870 A * 12/1988 Simpson ..... 102/342

OTHER PUBLICATIONS

Metal Storm Limited, International Search Report, PCT/AU03/00866, Jul. 21, 2003, 4pp.

Metal Storm Limited, International Preliminary Examination Report, PCT/AU03/00866, Feb. 18, 2004, 4pp.

Search Report, "International Search Report", PCT/AU03/00866, (Jul. 21, 2003),pp. 3.

* cited by examiner

*Primary Examiner*—Stephen M. Johnson
(74) *Attorney, Agent, or Firm*—Blakely Sokoloff Taylor & Zafman LLP

(57) ABSTRACT

An ignition arrangement for a barrel assembly (10) including a barrel (11) having a plurality of projectiles (15*a*, 15*b*, 15*c*) axially stacked within the barrel (11) together with respective propellant charges (20) for propelling the projectiles sequentially from the barrel, said ignition arrangement including a fuse (21, 22) disposed in a cavity (27) provided in a body (18) of each projectile, wherein the cavity (27) communicates both forwardly (28) and rearwardly (29) of the projectile body (18); whereby in use, said fuse (21) burns at a controlled rate in the cavity (27) and causes ignition of the propellant charge (20) associated with said projectile (15*a*), which in turn ignites the next following fuse (22) associated with a trailing projectile (15*b*).

34 Claims, 3 Drawing Sheets

IGNITION ARRANGEMENT FOR STACKED PROJECTILES

CROSS-REFERENCES TO RELATED APPLICATIONS

The present patent application is a national phase application of International Application No. PCT/AU03/000866 filed Jul. 4, 2003, which claims priority from Australian Application No. 2002950004 filed Jul. 5, 2002.

BACKGROUND OF THE INVENTION

1. Field of the Invention

The present invention relates to ignition arrangements for munitions and firearms. In particular, although not exclusively, the invention relates to fusing arrangements for igniting propellant charges associated with respective projectiles stacked axially within a barrel. The invention also relates to a method of igniting such propellant charges for stacked projectiles.

2. Discussion of the Background Art

There is disclosed in the prior art several proposals for igniting propellant charges associated with projectiles stacked axially within a barrel. In some of these proposals, electrical conductors are required for carrying ignition signals to individual propellant charges for each projectile in a barrel. This added to construction complexity of both individual barrel assemblies with stacked projectiles and to weapons pods incorporating clusters of barrel assemblies.

Whilst electronic ignition arrangements for individual projectiles discussed therein provide for maximum flexibility for firing each projectile, some applications of this technology call for less complex ignition arrangements.

The reference to any prior art in this specification is not, and should not be taken as, an acknowledgement or any form of suggestion that such prior art forms a part of the common general knowledge relating to the field of ignition systems for munitions and firearms in Australia.

SUMMARY OF THE INVENTION

Disclosure of the Invention

According to a first aspect of the present invention there is provided an ignition arrangement for a barrel assembly including a barrel having a plurality of projectiles axially stacked within the barrel together with respective propellant charges for discharging the projectiles sequentially from the barrel, said ignition arrangement including:

a cavity provided in a body of each projectile, wherein the cavity communicates both forwardly and rearwardly of the projectile body; and a fuse disposed in the cavity, which fuse includes a section formulated to burn at a predetermined rate;

whereby, in use, said fuse burns in the cavity to cause ignition of the propellant charge associated with said projectile.

The forward communication of the cavity allows burning of said fuse to be triggered by combustion of a forward propellant charge associated with the immediately preceding projectile in the axial stack of projectiles during discharge of said preceding projectile.

The fuse is preferably elongate and may comprise three sections, a forward section, a rear section and an intermediate section. The intermediate section suitably contains a fuse material formulated for burning at a predetermined rate or velocity, and is generally longer than said forward section or said rear section.

Preferably the projectile is provided with a first aperture that communicates between the cavity and forwardly of said projectile body and a second aperture that communicates between the cavity and rearwardly of the projectile body. Most preferably the cavity is aligned with an axis of the projectile, and suitably extends co-axially of said projectile. The first and second apertures are generally restricted in size compared with the cavity, the first aperture preferably being smaller than the second aperture.

The forward section of the fuse is composed of a fuse material ignitable by combusting propellant, which ignited forward section can, in turn, ignite the intermediate section of said fuse. In the case of the leading or forwardmost projectile in the barrel, the forward section of the fuse may be electrically ignited or mechanically ignited, suitably via the first or front aperture. A primer may be employed as required.

The intermediate section is composed of a fuse material selected to burn at a pre-determined longitudinal velocity and, at or shortly before conclusion of the intermediate material burn, the intermediate section will ignite the rear section of the fuse.

The fuse material of the intermediate section may also provide a sealing function, in that burnt fuse material can provide at least a partial seal within the cavity and/or the first aperture.

The rear section of the fuse is, accordingly, composed of a fuse material that is ignitable by the burning intermediate section and is able, in turn, to ignite the associated propellant charge via the second or rear aperture.

Preferably the fuse includes a rigid sleeve, suitably composed of metal, for containing fuse material. If required, the rigid sleeve is retained within the cavity provided in the body of the projectile.

The pre-determined burn velocity is calculated with reference to the desired period of time between ignition of propellant charges in the stack of projectiles. It will be appreciated that this calculation may need to account for the cross ignition times involving the forward section and the rear section of the fuse.

In another aspect of the invention, there is provided a barrel assembly including a barrel having a plurality of projectiles axially stacked within the barrel together with respective propellant charges for discharging the projectiles sequentially from the barrel, said barrel assembly characterised by an ignition arrangement as set out above.

In a further aspect of the invention, there is provided a projectile including a body portion having a cavity containing a fuse, said fuse including material formulated to burn at a predetermined rate, and wherein the projectile is provided with a first aperture that communicates between the cavity and forwardly of said projectile body and a second aperture that communicates between the cavity and rearwardly of the projectile body.

The projectile body is desirably composed of at least two separate components to facilitate convenient insertion of the fuse into the cavity, which components are suitably fixed together subsequent to fuse insertion thereby retaining the fuse within the projectile body. If required, the projectile components may be releasably coupled together.

The two components of the projectile body may include a head member suitably composed of steel and a tail member, suitably composed of aluminium and including a trailing skirt portion.

The propellant charge is suitably formed as a block, and may be contained within the trailing skirt portion.

The skirt portion may, in use, be engaged by a mandrel for urging an outer face of the trailing skirt portion into operative sealing engagement with the bore of the barrel. The mandrel may be formed by the propellant charge or by the head member of a trailing projectile. In another form, the nose portion of a trailing projectile may be urged into operative sealing engagement with an inner end face of the trailing skirt portion.

Alternatively, the projectile body may be formed in one piece and include a bore for retaining the fuse, which fuse suitably includes a tubular body retained in said bore.

Further alternative projectile configurations suited to provision of a fuse cavity and envisaged in earlier patent applications by the present applicant, including those described in International Application No. PCT/AU98/00409 and PCT/AU98/00414, are hereby expressly incorporated by reference.

In a still further aspect of the invention, there is provided a weapon including a cluster of barrel assemblies, each barrel assembly having a plurality of projectiles stacked within the barrel together with respective propellant charges for discharging the projectiles sequentially from the barrel, wherein each of said plurality of projectiles is as set out above.

In yet another aspect, the present invention provides a method of igniting a plurality of propellant charges associated with respective projectiles axially stacked with a barrel, wherein a fuse is disposed in a cavity provided in a body of each projectile, wherein the projectile is provided with a first aperture that communicates between the cavity and forwardly of said projectile body and a second aperture that communicates between the cavity and rearwardly of the projectile body, said method including the steps of:

igniting the fuse in the leading or forwardmost projectile in the barrel whereby, said fuse burns at a predetermined rate in the cavity and causes ignition of the propellant charge associated with said projectile;

which ignited propellant charge propels the leading projectile from the barrel and ignites the fuse contained in the next projectile in said stack;

whereby the remaining projectiles of said plurality of projectiles are subsequently propelled from the barrel in sequence.

BRIEF DETAILS OF THE DRAWINGS

In order that this invention may be more readily understood and put into practical effect, reference will now be made to the accompanying drawings which illustrate a typical embodiment of the invention and wherein.

DESCRIPTION OF EMBODIMENTS OF THE INVENTION

Figure 1:
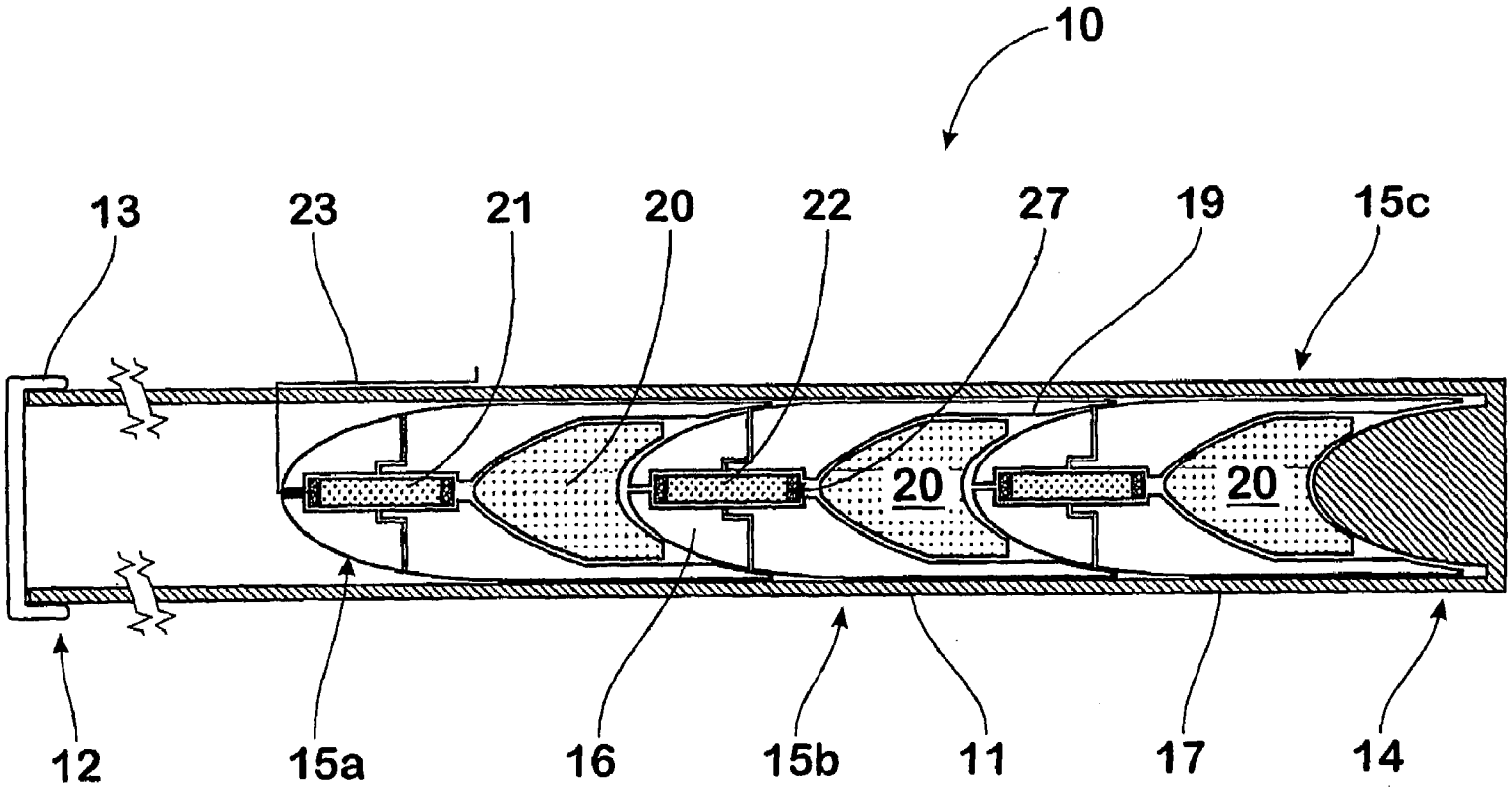
FIG. 1 is a schematic cross-sectional view of a barrel assembly incorporating an ignition arrangement of a first embodiment.

Referring to FIG. 1 there is shown a barrel assembly 10 including a barrel 11 having a muzzle end 12, having a barrel end cover 13 in place over the muzzle, and a rear end 14. The end cover 13 is constructed of plastics or cellulose material and prevents ingress of foreign matter into the barrel 11. In some applications of the invention, such as perimeter defence, a weapon employing such barrel assemblies will be exposed to weather for extended periods.

The barrel end cover 13 is optional and, in the case that a barrel end cover is employed, each barrel cover could be individually removed before firing or the barrel covers for a multi-barrelled weapon could be connected together in a manner allowing an operator to remove them all at once from the side of the weapon. In the case of individually removed barrel covers, the barrel cover could be removed by the action of the first projectile leaving the barrel; i.e. the forward movement of the first projectile will compress air behind the barrel end cover which would forcibly remove the barrel cover from its position without the first projectile impacting on it.

The barrel contains a plurality of projectiles 15*a*, 15*b*, 15*c*, each having a body 18 comprising a head member 16 and a tail member 17. The tail member 17 further includes a rearwardly extending skirt portion 19 that abuts a rearward projectile in the present embodiment. Further details of the projectile 15, particularly in relation to a cavity 27 provided in the projectile body 18, are described below in relation to FIG. 2.

The projectiles 15 are axially stacked within the barrel together with respective propellant charges 20, which charges are arranged within the skirt portion 19 of each projectile. The propellant charges 20 are formed in the present embodiment as a solid block, each suitably having a graduated weight of propellant. The graduated weight of propellant charges allows the muzzle velocity of the projectiles 15 in the stack to be varied. For example, in some applications, it may be desirable for the projectiles to arrive at a target almost simultaneously.

An inner end face 30 of the skirt portion 19 is engaged by a nose portion of a trailing projectile, which acts as a mandrel, urging an outer face 33 of the trailing skirt portion 19 into operative sealing engagement with the bore of the barrel 11. In an alternative embodiment, the tail member of the projectile may be more rigid, and have a complementary face to that of the head of a trailing projectile, whereby sealing engagement may be formed between projectiles. In the alternative embodiment, propellant charges may be sealed with respective projectiles. This sealing arrangement is described further in the present applicant's co-pending International Patent Application No. PCT/AU 03/00318 dated 17 Mar. 2003.

A cavity 27 is provided in each projectile body 18 for containing a fuse 22 that is part of the ignition arrangement for the propellant charges 20. The cavity 27 is cylindrically shaped and co-axially located in the projectile, and communicates both forwardly and rearwardly of the projectile body 18. The cavity communicates forwardly of the projectile body 18 via a first aperture 28 provided in the head member 16, and rearwardly via a second aperture 29 in the tail member 17. It will be appreciated that, in alternative embodiments, the cavity which extends from front to rear of the projectile could be any one of a number of forms, other than cylindrically shaped and/or co-axially located in the projectile.

In the embodiment, the leading or forwardmost projectile 15*a* in the barrel contains a starter fuse 21 which is adapted for ignition by an electrical signal supplied from a fire control unit (not shown) via an ignition circuit 23. However the fuses 22 contained in the remaining projectiles 15*b*, 15*c* in the stack are adapted to be ignited by combustion of the propellant charge 20 associated with the projectile (ie. 15*a*, 15*b*) immediately forward of, or preceding in the axial stack, the projectile in question. It should be noted that a single electrical signal is all that is required to initiate discharge of the plurality of projectiles 15 from the barrel 11 in the present embodiment.

Other embodiments may employ chemical or mechanical initiation of the fuses, and may also include separately initiated chains of projectiles in a single barrel. For example, one barrel containing a stack of twelve (12) projectiles fused in three (3) groups of four (4) projectiles may be served by three (3) circuits for separately initiating each group as desired. In this case the leading projectile in each chain need not have an internal fuse, rather another primary ignition fuse coming from outside the barrel could initiate the propellant behind said leading projectile. A variation on the ignition circuit is the use of a single circuit which delivers a coded ignition signal to all three (3) starter fuses, wherein each starter only responds to a specific individual code.

Figure 2:
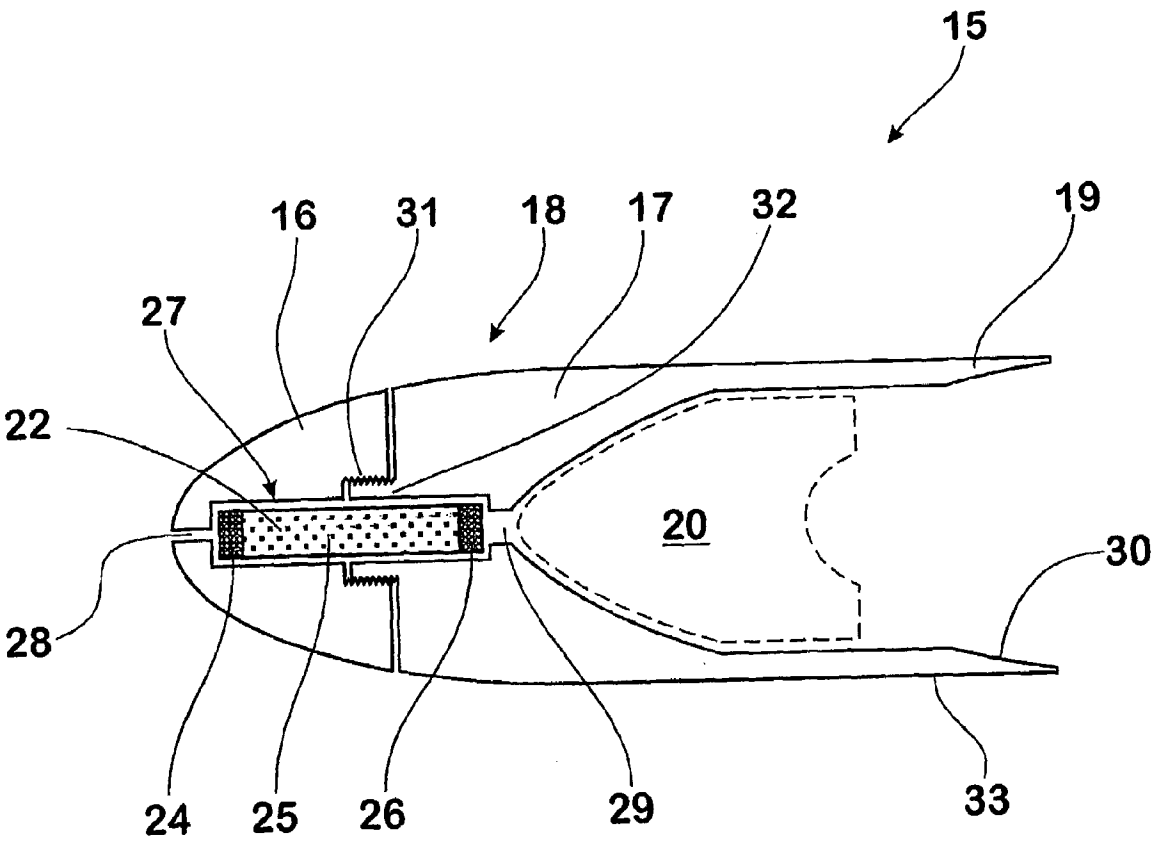
FIG. 2 is a further schematic cross-sectional view of a projectile incorporating a fuse of the first embodiment.

Referring particularly to FIG. 2, the head 16 and tail 17 components of the projectile body 18 are arranged to be assembled together subsequent to insertion of the fuse 22 into the co-axial cavity 27. The head member 16 includes a socket portion 31 which is engaged by a spigot portion 32 of the tail member 17, which portions might include cooperating screw threads to facilitate subsequent release, but in any event can be fixed together to retain the fuse 22 therein. In the embodiment, the head member 16 is composed of steel, whilst the tail member 17 is composed of an aluminium alloy.

When assembled, the co-axial cavity 27 communicates forwardly of the projectile body 18 via a front aperture 28 conveniently formed in the head member 16. The co-axial cavity 27 also communicates rearwardly of the projectile body 18 via a rear aperture 29 conveniently formed to the tail member 17. In particular the rear aperture exits the tail member in the vicinity of the propellant charge 20 associated with the projectile 15.

The diameter of the front aperture 28 is quite restricted in size compared with the cavity 27 in order to minimise passage of combustion products and loss of pressure when a forward propellant charge combusts. The diameter of the rear aperture is also relatively restricted, but not to the same extent as the front aperture, in order to facilitate ignition of the rearward propellant charge 20 (shown in phantom). Both apertures 28, 29 are desirably smaller in size than the fuse 22 in order to retain the fuse within the cavity 27.

The fuse 22 is constructed of three sections in the embodiment, a front section 24, an intermediate section 25 and a rear section 26. The front section 24 is composed of a fuse material which is capable of being ignited by a forwardly disposed combusting propellant charge through the front or first aperture 28. In contrast, the rear section 26 of the fuse 22 is composed of a fuse material which is capable of igniting a rearwardly disposed fresh propellant charge through the rear or second aperture 29. The fuse material may be retained in a tubular housing, suitably composed of thin metallic material.

More importantly, the intermediate section 25 of the fuse 22 is composed of a fuse material which is sized and formulated to burn at a predetermined rate, particularly at a desired velocity along its length, and also to ignite and be ignited by respective rear and front sections of the fuse. Suitable fuse material having these characteristics, such as the delay compositions set out in Table 1 below, may be sourced from The Ensign Bickford Company of Simsbury, Conn.

TABLE 1

| Delay Composition | Spec. | Formulation |
|---|---|---|
| Zirconium Nickel Alloy Delay Composition | MIL-C-13739A | Zirconium Nickel Alloy, Powdered, MIL-Z-11410<br>Barium Chromate, MIL-B-550<br>Potassium Perchlorate, MIL-P-217 |
| Manganese Delay Composition | MIL-M-21383A | Manganese Powder, JAN-M-476<br>Barium Chromate, MIL-B-550<br>Lead Chromate, JAN-L-488 |
| Tungsten Delay Composition | MIL-T-23132A | Tungsten Powder, AS-2686<br>Barium Chromate, MIL-B-550<br>Potassium Perchlorate, MIL-P-217 |

The burn velocity of the fuse material in the intermediate section is chosen in light of the desired time between ignition of propellant charges and consequent projectile discharges. The rate of burn of the fuse is in part due to the density at which the delay composition is packed into the fuse chamber and also the physical dimensions of the chamber itself. It is envisaged that the fuse link construction of the invention will facilitate rates of fire of, for example 600 rounds per minute (rpm), 60,000 rpm and perhaps up to 600,000 rpm in a multiple barrel configuration. The rate of fire from a single barrel is typically expected to be between 300 and 45,000 rpm.

In another embodiment of the invention, the composition of the intermediate material is selected, such that when burnt, the residual melted material (perhaps a filler) provides a sealing action in the front aperture 28 and/or across the cavity 27 to further mitigate pressure loss. Alternatively, the fuse may be provided with a housing which melts and obturates the cavity 27 during or consequent to fuse burning. The constrictions in the front and rear of the fuse chamber in the projectile of the first embodiment are designed to aid in this procedure.

The front and rear sections 24, 26 capping the ends of the fuse 22 are provided because it is believed that the fuse material suited to controlled burning at a stable rate may be unable to reliably initiate combustion of the propellant charges 20 and vice-versa. Where a suitably synergistic fuse material and propellant can be specified, the front and rear sections capping the fuse may not be required. In some embodiments, the sections may include an initiating additive in quantities graded longitudinally from each end of the fuse as desired, and in order to better facilitate cross-ignition between adjacent sections.

Figure 3:
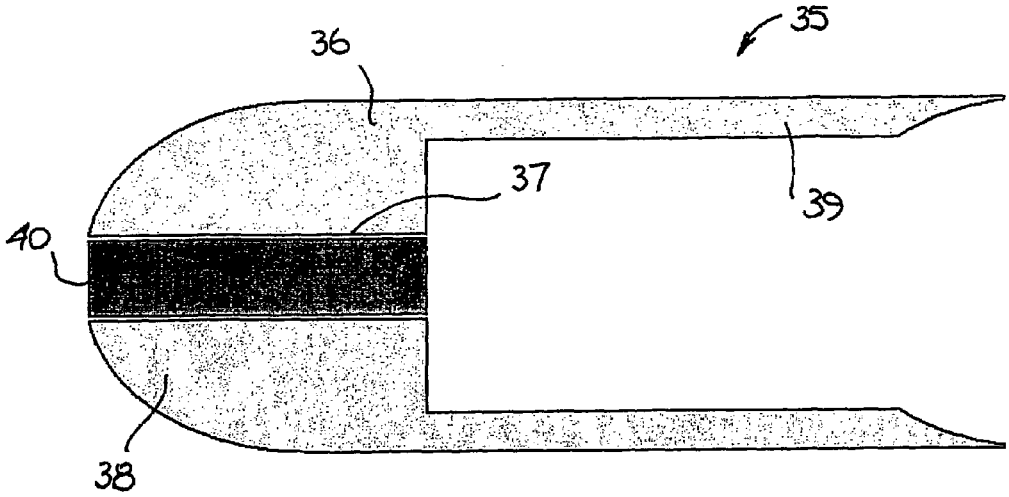
FIG. 3 is a schematic cross-sectional view of a further projectile incorporating a fuse of a second embodiment of the invention.
Figure 4:
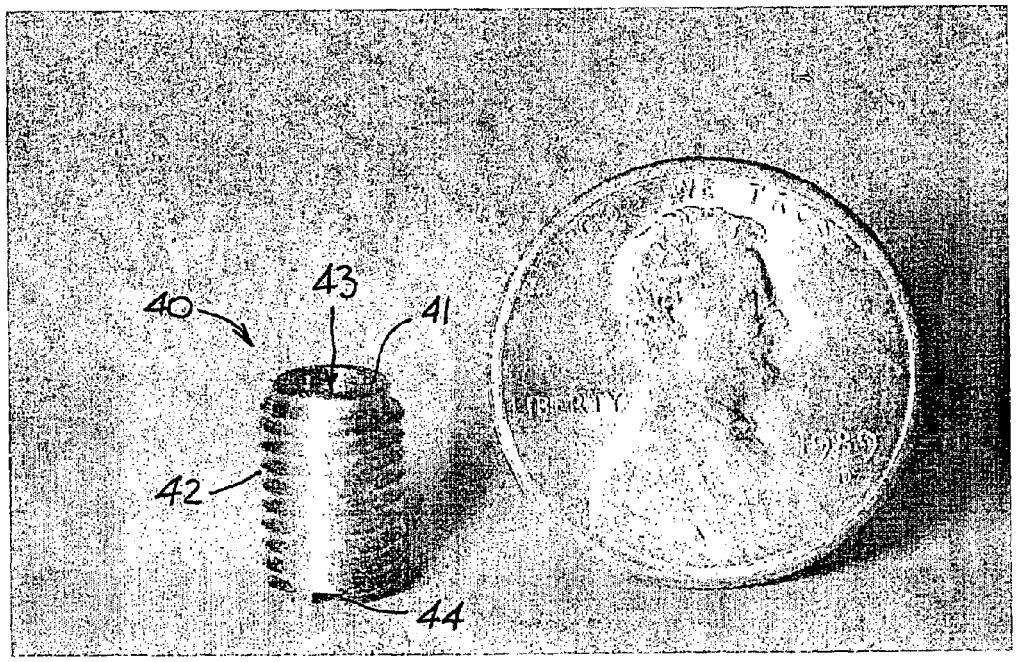
FIG. 4 is perspective view of a housing for the fuse of the second embodiment.

A second embodiment of the ignition arrangement of the invention will now be described in relation to FIGS. 3 and 4. FIG. 3 depicts a cross-sectional view of a projectile 35 which, in contrast to the first embodiment, has a single piece or unitary body 36 with a threaded longitudinal bore 37 provided in a head portion 38 of the body. The bore defines a cavity for retaining a fuse 40, which cavity communicates both forwardly of the head portion 38 and rearwardly toward a tail portion 39 of the projectile. In another form, the projectile bore may be relatively smooth to enable a similarly configured fuse to be pressed into the projectile body and retained by interference fit.

A fuse 40 for the ignition arrangement of the second embodiment has a body 41 adapted for insertion into the projectile bore 37 is illustrated in FIG. 3. The fuse body 41 is in the form of a sleeve, having an external screw-thread 42 and an internal cavity 43 containing fuse material (not shown). A slot 44 is provided across an end face of the fuse body 41 to facilitate engagement by a tool for insertion of the fuse 40 into the projectile body 36.

In further contrast to the fuse of the first embodiment, neither the cavity provided in the projectile body 36, nor the internal cavity 43 in the fuse 40 are provided with restricted apertures or similar end constrictions. The fuse material is pressed into the internal cavity of the fuse and forms a stable compacted mass. It will be appreciated that other embodiments of the invention may employ constrictions in either or both of the fuse body 41 and/or the projectile body 36, as required.

The illustrated fuse 40 is designed for insertion into a 15.7 mm projectile and employed, at least for the delay section of the fuse, a material composed of 'Formula 181 Ignition Mixture "A1A"', as supplied by Eagle Picher of Joplin, Mo. USA. The formula for the Ignition Mixture "A1A" is as follows:

| | |
|---|---|
| Zirconium | 65% (120A Foote Mineral Co., or equivalent.) |
| Red Iron Oxide, JAN-I-706 | 25% (with exceptions) |
| Superfloss ™ | 10% ("Superfloss" is a trademark for a finely ground and calcined diatomaceous earth). |

It will be appreciated that fuse compounds and propellant types can only be ascertained once the application for which the ignition system and projectiles are to be used is decided. The characteristics of the fuse, propellant and fuse cavity are all dependant on the calibre and muzzle velocity required for a particular application. For a certain calibre and muzzle velocity, a certain type and amount of propellant may be chosen. The choice of propellant is then a pre-requisite for choosing an appropriate fuse composition, the choice of fuse composition in turn being a determined to a degree by the available dimensions of the fuse cavity.

Certain embodiments of the ignition fuse arrangement of the invention may provide several advantages, including:

1. The very greatly reduced opportunity for a following projectile to be ignited without the leading projectile having been previously ignited. It is believed to be almost impossible for a projectile to be 'skipped' and for a following or rearward projectile to be ignited when projectile(s) are still in forward of the projectile in question that haven't yet been ignited.
2. The system also reduces the number of wire loops from one for each projectile in existing electrical initiation systems, wherein conductors are provided for each propellant charge, to one conductor for each barrel. This means that a barrel assembly utilising the invention is much less prone to electrical failure as well as being lighter and smaller.
3. Pursuant to 2 above, the barrel assembly requires a very much smaller and simpler fire control unit.
4. Finally, the ignition arrangement reduces cost of manufacture by a significant degree.

Although it will be appreciated that initiation of the leading propellant charge will result in the discharge of a plurality of projectiles from the barrel through the chain of fuses 22 and projectile charges 20, there are many situations where this need not be a disadvantage.

The fuse type ignition arrangement of the invention can be incorporated into barrel assemblies, whether of existing or proposed configuration. For example, a number of these barrel assemblies employing the ignition arrangement of the invention can quite easily be clustered together in a 'pod' configuration, such as described in the above referenced patent applications. Whilst an accepted benefit of having more than one barrel is that a pod type weapon system becomes repeatable, and different barrels may be loaded with different types and numbers of projectiles.

Accordingly, any application wherein a fixed number of projectiles are to be fired in any one instance is suitable for the invention. A specific example of such an application is vehicle self-defence against shoulder launched anti-tank missiles. In this case a pre-determined number of projectiles can be fired from barrels in a pod in order to achieve the requisite high degree of probability of interception of the missile. Such pods as these can be placed on a vehicle, such as a tank, to deal with the threat of shoulder launched anti-tank missiles.

Anti-tank missiles will typically be launched at a vehicle from relatively close ranges, such as 0.5 Km for example. The difficulty for the tank is that the time of flight of the missile is therefore very short, and although electronic detection of the threat can be almost immediate, it is very difficult for a vehicle self defence system, such as a missile or machine gun, to react rapidly and effectively enough to deal with the treat.

In the case of a machine gun, by the time it turrets onto the threat and starts firing, it will be lucky to get a few rounds fired at best. However, a compact and lightweight pod can turret more rapidly. The pod can fire from numerous barrels which can optionally be splayed to open up the pattern of fire at ultra rapid rates to produce a 'cone' of projectiles toward the missile. This contrasts with machine gun fire which can deliver a point-on-point impact of only one very slow line of fire. With barrel splay, the pod can engage a target fired at close range with numerous rounds even before the centre line of the pod has completed turreting onto the target.

In this specification, use of the terms "forward" or "forwardly" indicate a direction towards the muzzle of the barrel and away from the breech end of the barrel and, conversely, use of the terms "rearward" or "rearwardly" indicate a direction towards the breech end of the barrel and away from the muzzle.

It will of course be realised that the above has been given only by way of illustrative example of the invention and that all such modifications and variations thereto as would be apparent to persons skilled in the art are deemed to fall within the broad scope and ambit of the invention as is herein set forth in the following claims.

The invention claimed is:

1. An ignition arrangement for a barrel assembly comprising:

a barrel having a plurality of projectiles axially stacked within the barrel together with respective propellant charges for discharging the projectiles sequentially from the barrel, said ignition arrangement including:

a cavity provided in a body of each projectile, wherein the cavity communicates both forwardly and rearwardly of the projectile body; and a fuse disposed in the cavity, including a first section formulated to bum at a pre-determined rate and a second section formulated to provide a sealing function, wherein the fuse burns in the cavity to cause ignition of the propellant charge associated with said projectile and provides at least a partial seal within the cavity.

2. The ignition arrangement of claim 1 wherein said forward communication of the cavity allows burning of said fuse to be triggered by combustion of a forward propellant charge associated with an immediately preceding projectile in the axial stack of projectiles during discharge of said preceding projectile.

3. The ignition arrangement of claim 1 wherein the fuse is elongate and comprises three sections, a forward section, a rear section and an intermediate section.

4. The ignition arrangement of claim 3 wherein the intermediate section of the fuse contains a fuse material formulated for burning at a predetermined longitudinal rate or velocity.

5. The ignition arrangement of claim 4 wherein the pre-determined longitudinal burn velocity is calculated with reference to a desired period of time between ignition of propellant charges in said axial stack of projectiles.

6. The ignition arrangement of claim 3 wherein the forward section of the fuse is composed of a fuse material ignitable by combusting propellant, which ignited forward section can, in turn, ignite the intermediate section of said fuse.

7. The ignition arrangement of claim 3 wherein the forward section of the fuse contained in the forward most projectile in the barrel is electrically ignited or mechanically ignited.

8. The ignition arrangement of claim 3 wherein the intermediate section is composed of a fuse material selected to burn at a pre-determined longitudinal velocity and, at or shortly before a conclusion of the intermediate material burn, the intermediate section ignites the rear section of the fuse.

9. The ignition arrangement of claim 3 wherein the rear section of the fuse, is composed of a fuse material that is ignitable by the burning intermediate section and is able, in turn, to ignite the associated propellant charge.

10. The ignition arrangement of claim 1 wherein the fuse includes a rigid sleeve containing fuse material.

11. The ignition arrangement of claim 10 wherein the rigid sleeve is retained within the cavity provided in the body of the projectile.

12. The ignition arrangement of claim 1 wherein the projectile body is provided with a first aperture that communicates between the cavity and forwardly of said projectile body, and a second aperture that communicates between the cavity and rearwardly of the projectile body.

13. The ignition arrangement of claim 12 wherein the cavity is aligned with a longitudinal axis of the projectile.

14. The ignition arrangement of claim 12 wherein said first aperture and said second aperture are generally restricted in size compared with the internal diameter of the cavity.

15. The ignition arrangement of claim 12 wherein the first aperture is arranged to enable ignition of said forward section of the fuse by combusting propellant of an immediately preceding projectile in said axial stack.

16. The ignition arrangement of claim 12 wherein the second aperture is arranged to enable ignition of an associated propellant charge by the burning rear section of the fuse.

17. An ignition arrangement for a barrel assembly comprising:

a barrel having a plurality of projectiles axially stacked within the barrel together with respective propellant charges for discharging the projectiles sequentially from the barrel, said ignition arrangement including a cavity provided in a body of each projectile, wherein the cavity communicates both forwardly and rearwardly of the projectile body, a fuse disposed in the cavity, including a section formulated to burn at a pre-determined rate, wherein the fuse burns in the cavity to cause ignition of the propellant charge associated with said projectile, wherein the fuse is elongate and comprises three sections, a forward section, a rear section and an intermediate section, wherein the fuse material of the intermediate section provides a sealing function, whereby the burnt material of the intermediate section provides at least a partial seal within the cavity.

18. A barrel assembly including a barrel having a plurality of projectiles axially stacked within the barrel together with respective propellant charges for discharging the projectiles sequentially from the barrel, said barrel assembly characterized by an ignition arrangement, the ignition arrangement comprising:

a cavity provided in a body of each projectile, wherein the cavity communicates both forwardly and rearwardly of the projectile body; and a fuse disposed in the cavity, including a first section formulated to burn at a pre-determined rate and a second section formulated to provide a sealing function, wherein the fuse burns in the cavity to cause ignition of the propellant charge associated with said projectile and provides at least a partial seal within the cavity.

19. The barrel assembly of claim 18 wherein said forward communication of the cavity allows burning of said fuse to be triggered by combustion of a forward propellant charge associated with an immediately preceding projectile in the axial stack of projectiles during discharge of said preceding projectile.

20. The barrel assembly of claim 18 wherein the fuse is elongate and comprises three sections, a forward section, a rear section and an intermediate section.

21. The barrel assembly of claim 20 wherein the intermediate section of the fuse contains a fuse material formulated for burning at a predetermined longitudinal rate or velocity.

22. The barrel assembly of claim 20 wherein the forward section of the fuse is composed of a fuse material ignitable by combusting propellant, which ignited forward section can, in turn, ignite the intermediate section of said fuse.

23. The barrel assembly of claim 20 wherein the forward section of the fuse contained in the forward most projectile in the barrel is electrically ignited or mechanically ignited.

24. The barrel assembly of claim 20 wherein the intermediate section is composed of a fuse material selected to burn at a pre-determined longitudinal velocity and, at or shortly before a conclusion of the intermediate material burn, the intermediate section ignites the rear section of the fuse.

25. The barrel assembly of claim 20 wherein the burnt material of the intermediate section provides at least a partial seal within the cavity.

26. The barrel assembly of claim 20 wherein the rear section of the fuse, is composed of a fuse material that is ignitable by the burning intermediate section and is able, in turn, to ignite the associated propellant charge.

27. The barrel assembly of claim 20 wherein the predetermined longitudinal bum velocity is calculated with reference to a desired period of time between ignition of propellant charges in said axial stack of projectiles.

28. The barrel assembly of claim 18 wherein the fuse includes a rigid sleeve containing fuse material.

29. The barrel assembly of claim 28 wherein the rigid sleeve is retained within the cavity provided in the body of the projectile.

30. The barrel assembly of claim 18 wherein the projectile body is provided with a first aperture that communicates between the cavity and forwardly of said projectile body, and a second aperture that communicates between the cavity and rearwardly of the projectile body.

31. The barrel assembly of claim 30 wherein the cavity is aligned with a longitudinal axis of the projectile.

32. The barrel assembly of claim 30 wherein said first aperture and said second aperture are generally restricted in size compared with the internal diameter of the cavity.

33. The barrel assembly of claim 30 wherein the first aperture is arranged to enable ignition of said forward section of the fuse by combusting propellant of an immediately preceding projectile in said axial stack.

34. The barrel assembly of claim 30 wherein the second aperture is arranged to enable ignition of an associated propellant charge by the burning rear section of the fuse.

* * * * *